US007052318B2

(12) United States Patent
Tanaka et al.

(10) Patent No.: US 7,052,318 B2
(45) Date of Patent: May 30, 2006

(54) CONNECTOR

(75) Inventors: Shigeru Tanaka, Haibara-gun (JP); Shinichi Tsuchiya, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/002,134

(22) Filed: Dec. 3, 2004

(65) Prior Publication Data

US 2005/0142939 A1 Jun. 30, 2005

(30) Foreign Application Priority Data

Dec. 4, 2003 (JP) ..... P2003-405533

(51) Int. Cl.
*H01R 13/40* (2006.01)

(52) U.S. Cl. ..... 439/595

(58) Field of Classification Search ..... 439/595, 439/353, 354, 344–345, 676
See application file for complete search history.

(56) References Cited

U.S. PATENT DOCUMENTS 4,241,974 A * 12/1980 Hardesty ..... 439/638
4,626,057 A 12/1986 Knickerbocker
5,328,390 A * 7/1994 Johnston et al. ..... 439/638
6,773,291 B1 * 8/2004 Roth et al. ..... 439/344
6,863,554 B1 * 3/2005 Glad ..... 439/344
2004/0137798 A1 7/2004 Kuiken et al.

FOREIGN PATENT DOCUMENTS

| | | | |
|---|---|---|---|
| EP | 0 762 558 | A3 | 2/1998 |
| JP | 2001-68214 | A | 3/2001 |
| JP | 2001-203038 | A | 7/2001 |
| WO | WO 00/36709 | A3 | 6/2000 |

* cited by examiner

*Primary Examiner*—J. F. Duverne
(74) *Attorney, Agent, or Firm*—Sughrue Mion, PLLC

(57) ABSTRACT

A connector 10, by forming an elastically deformable locking arm 13 integrally with a connector housing 11, providing a fixing projection 14 for the look arm 13, and causing the locking arm 13 to deform elastically to guide the fixing projection 14 in the mating connector and fix the fixing projection 14 to the mating connector, locks in the mating connector. The locking arm 13, since an elastic deformation portion 17 is extended from a proximal end portion 16 to the fixing projection 14 linearly in a slant state, and an arm portion 18 is extended from the fixing projection 14 along an outer surface 12A, is V-shaped; and between an end portion 18A of the arm portion 18 and the connector housing 11, space 19 is formed.

4 Claims, 4 Drawing Sheets

CONNECTOR

BACKGROUND OF THE INVENTION

1. Field of the Invention

The present invention relates to a connector, and particularly to a connector which provides a fixing projection for a locking arm of a connector housing, and fixes the fixing projection in the mating connector by causing this locking arm to deform elastically, thereby to lock in the mating connector.

2. Related Art

In connectors, there is a connector so constructed that a locking arm is provided on an outer surface, and a fixing projection of the locking arm is fixed to the mating connector when the connector is inserted into the mating connector as shown in Unexamined Japanese Patent Publication 2001-68214.

In the connector of the above reference, as shown in FIG. 5, a locking arm 102 is formed integrally on an outer surface 101 of a connector housing 100.

This locking arm 102 is formed by raising a base end portion 103 from the outer surface 101 of the connector housing 100, and extending a cantilevered arm portion 105 from an end portion 103A of this base end portion 103 along the outer surface 101 of the connector housing 101. In this arm portion 105, a fixing projection 106 is formed.

This connector is inserted into the mating connector (not shown), whereby the arm portion 105 comes into contact with the mating connector. As the arm portion 105 is deformed elastically in the direction of an arrow, it is put in the state shown by solid lines of FIG. 6.

When the fixing projection 106 of the arm portion 105 reaches a hood portion of the mating connector, the arm portion 105 is subjected to elastic restoration and put in the state shown by imaginary lines of FIG. 6.

The fixing projection 106 fixes to the hood portion of the mating connector, whereby the connector is locked in the mating connector in an engaged state.

It is thought that this connector, though it is formed of non-tempered glass under the existing circumstances, is formed of glass reinforced material that is low in the unit cost of material in order to hold the cost.

However, the glass reinforced material is, than the non-reinforced material, higher in bending elastic modulus and lower in allowable distortion.

Therefore, in case that the connector is manufactured with the glass reinforced material, there is fear that the locking arm 102 is easy to bend.

Here, elastic deformation of the arm portion 105 constituting the locking arm 102 will be described with reference to FIG. 7.

The arm portion 105 has a cantilevered support structure in which the base end portion 103 is a fulcrum, and the end portion, that is, the fixing projection 106 is a free end. Of the arm portion 105, the shape from the base end portion 103 to the fixing projection 106 can be shown as shown in FIG. 7.

Displacement δ of the fixing projection 106 is expressed by $$\delta=PL^3/(3EI) \quad (1),$$

Wherein P is reaction force of the arm portion 105, L is a length of the arm portion 105, E is a Young's modulus, I is a moment of inertia of area ($I=bt^2/12$), b is a width of the arm portion 105, and t is a thickness of the arm portion 105.

Stress σ is expressed by $\sigma=M/Z$ (2), wherein M is a bending moment (M=PL), and Z is section modulus of the arm portion 105 ($Z=bt^2/6$).

From the expressions (1) and (2), the following expression is formed:

$$\sigma=3Et\delta/(2L^2) \quad (3)$$

From the expression (2), the following expression is formed:

$$P=bt^2/(6L\sigma) \quad (4)$$

From the expressions (3) and (4), it is found that when the thickness t of the arm portion 105 is reduced the reaction force P of the arm portion 105 becomes small.

Therefore, when the arm portion 105 is made difficult to bend by reducing the thickness t of the arm portion 105, the reaction force P of the arm portion 105 becomes small.

In case that the reaction power P of the arm portion 105 becomes small, there is fear that when the connector is engaged with the mating connector, engagement feeling becomes bad.

As a method of improving this engagement feeling, it is thought that the width b of the arm portion 105 is made large.

However, in case that the width b of the arm portion 105 is made large, when the connector is engaged with the mating connector, clearance for engagement with the mating connector cannot be secured.

Further, as another measure, it is thought that the position of the fixing projection 106 of the arm portion 105 is moved to an end portion 102A side of the locking arm 102 thereby to make the length L from the base end portion 103 to the fixing projection 106 large.

By making the length L from the base end portion 103 to the fixing projection 106 large, it is possible to make the arm portion 105 difficult to bend.

However, in case that the length L of the arm portion 105 from the base end portion 103 to the fixing projection 106 is made large, there is fear that the fixing projection 106 cannot fix in the mating connector.

SUMMARY OF THE INVENTION

The invention has been made in view of the beforementioned problems, and its object is to provide a connector which can hold the cost and can secure good engagement feeling.

In order to achieve the above object, a connector of the invention, which forms an elastically deformable locking arm integrally on an outer surface of a connector housing, provides a fixing projection for this look arm, and causes this locking arm to deform elastically to guide the fixing projection in the mating connector and fix the fixing projection in the mating connector, thereby to lock in the mating connector, is provided in that: the locking arm, since an elastic deformation portion is extended from a base end portion to the fixing projection linearly in a slant state, and an arm portion is extended from this fixing projection along the outer surface, is V-shaped; and between an end portion of this arm portion and the outer surface, space for causing the elastic deformation portion to deform elastically when the connector is engaged with the mating connector is formed.

In the thus constructed connector, since the elastic deformation portion is extended from the base end portion to the fixing projection linearly in the slant state, though the height of the fixing projection having the base end portion as a starting point is the same as that of the conventional fixing projection, a virtual rotational center of the locking arm comes close to the base end portion. Therefore, the distance between the virtual rotational center of the locking arm and the fixing projection can be made larger than the distance in the conventional case.

Accordingly, in this connector, compared with the conventional connector, high repulsion force is obtained in the fixing projection.

According to the invention, the elastic deformation portion is extended linearly in the slant state to secure the high repulsion force in the fixing projection. Hereby, even if the material of the connector is changed to the glass reinforced material, good engagement feeling can be secured in engagement with the mating connector.

In addition, the elastic deformation portion is extended linearly in the slant state to secure the high repulsion force in the fixing projection. Therefore, by changing the material of the connector to the glass reinforced material, the cost of the connector can be held.

DETAILED DESCRIPTION OF THE PREFERRED EMBODIMENTS

An embodiment of the invention will be described below in detail with reference to drawings.

Figure 1:
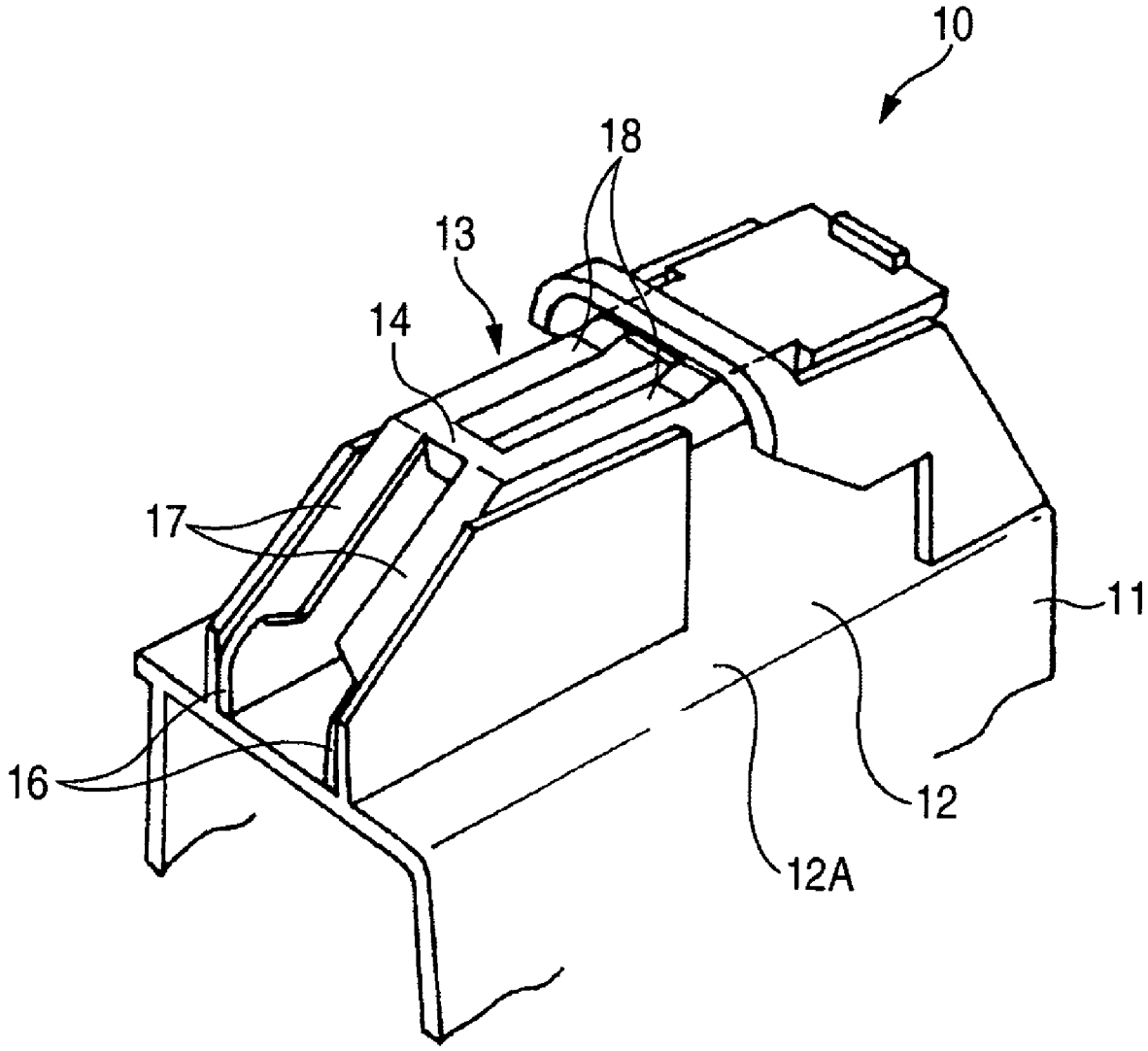
FIG. 1 is a perspective view showing a main portion of a connector according to the invention.

As shown in FIG. 1, a connector 10 according to a first embodiment is integrally formed of tempered glass.

This connector 10 forms an elastically deformable locking arm 13 integrally on an outer surface 12 of a connector housing 11, provides a fixing projection 14 for this look arm 13, and causes this locking arm 13 to deform elastically to guide the fixing projection 14 in the mating connector (not shown) and fix the fixing projection 14 in the mating connector, thereby to lock in the mating connector.

The connector housing 11 is formed, in its section, in the shape of a nearly rectangular barrel, and a terminal metal fitting that is fixed to a terminal of a not-shown wire harness is inserted from the backside of the housing 11 into the inside of the housing 11.

By engaging this connector housing 11 with the mating connector, the not-shown metal fitting is connected to a terminal of the mating connector.

On the outer surface 12 of this connector housing 12, and specifically on an upper surface 12A of the outer surface 12, the locking arm 13 is formed integrally.

Figure 2:
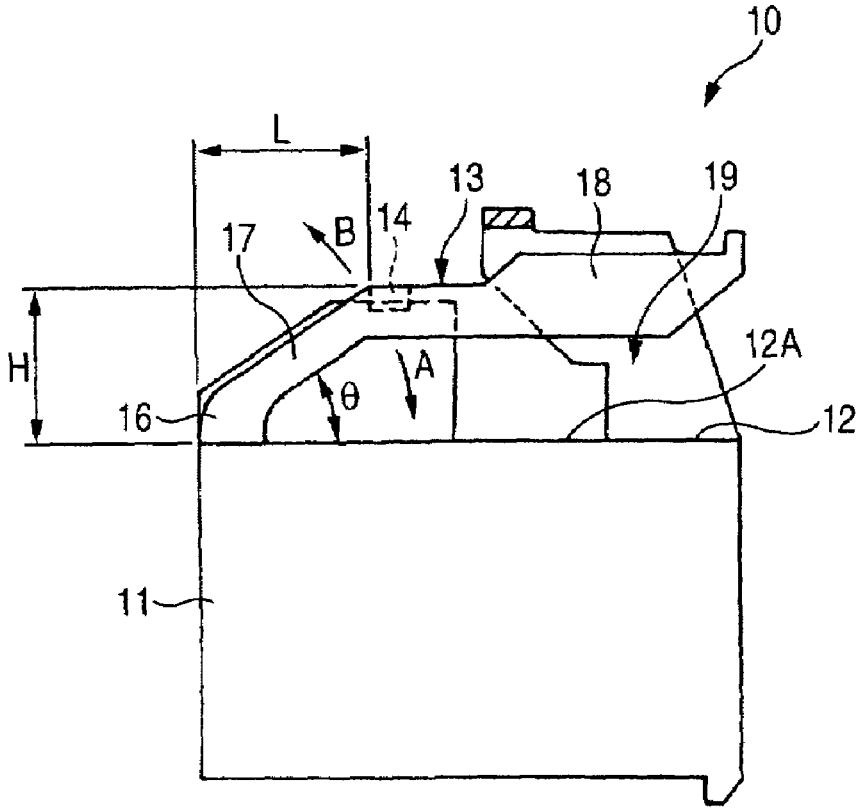
FIG. 2 is a side view showing the connector according to the invention.

As shown in FIG. 2, the locking arm 13, since an elastic deformation portion 17 is extended from a proximal end portion 16 to the fixing projection 14 linearly in a slant state of an angle of inclination θ, and the arm portion 18 is extended from this fixing projection 14, that is, from an end of the elastic deformation portion 17 along the outer surface 12A, is V-shaped. Between an end portion 18A of the arm portion 18 and the outer surface 12A, space 19 for causing the elastic deformation portion 17 to deform elastically when the connector 10 is engaged with the mating connector is formed.

By extending the elastic deformation portion 17 from the proximal end portion 16 to the fixing projection 14 linearly in the slant state, the fixing projection 14 is arranged in a higher position than the proximal end portion 16 by H, and in a position that is L distant from the proximal end portion 16. Namely, the fixing projection 14 is arranged diagonally to the upper side of the proximal end portion 16.

This elastic deformation portion 17 is rectangularly formed in its section, and formed so that with the proximal end portion 16 as a fulcrum, the fixing projection 14 can move in a direction (direction of an arrow A) in which the fixing projection 14 comes close to the upper surface 12A of the connector housing 11, and in a direction (direction of an arrow B) in which the fixing projection 14 separates from the upper surface 12A of the connector housing 11.

Therefore, when the connector 10 is engaged with the mating connector, the fixing projection 14 comes into contact with an inner surface (not shown) of a hood portion provided for the mating connector.

Hereby, the elastic deformation portion 17 deforms elastically in the direction of the arrow with the proximal end portion 16 as the fulcrum, that is, in the direction (direction of the arrow A) in which the fixing projection 14 comes close to the upper surface 12A of the connector housing 11.

Figure 3:
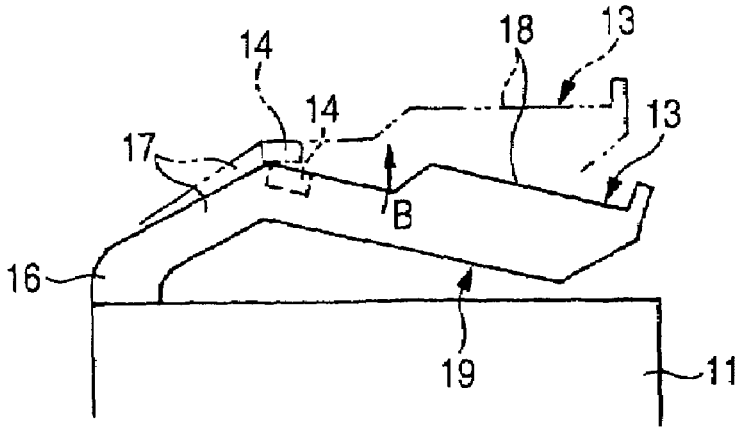
FIG. 3 is a diagram for explaining the work of a locking arm of the connector according to the invention.

Hereby, the locking arm 13 is put in the state shown by solid lines of FIG. 3.

Next, when the connector 11 is put in a properly engaged state with the mating connector, the elastic deformation portion 17 is subjected to elastic restoration in the direction of the arrow B, that is, in the direction in which the fixing projection 14 separates from the upper surface 12A of the connector housing 11, and the locking arm 13 is put in the state shown by imaginary lines of FIG. 3.

Therefore, the fixing projection 14 fixes in a lock hole (not shown) formed in the hood portion of the mating connector. Hereby, the connector 10 can be locked in the mating connector in the properly engaged state.

Here, the elastic deformation of the elastic deformation portion 17 will be described with reference to FIG. 4.

Figure 4:
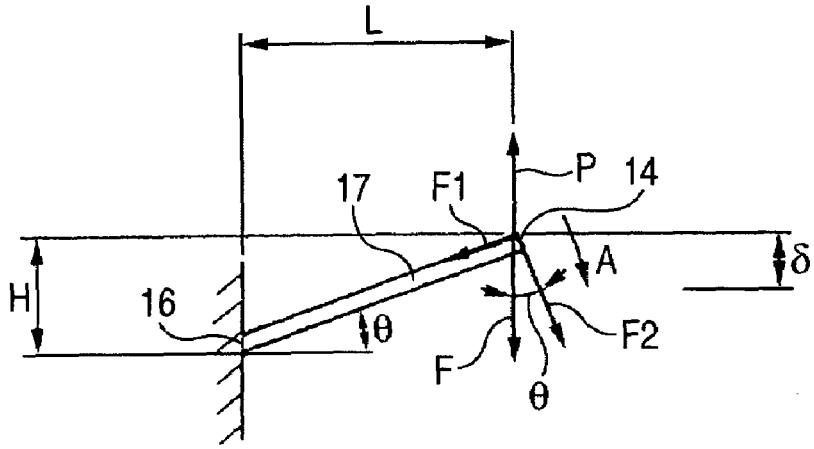
FIG. 4 is a concept diagram for explaining a feature of the locking arm of the connector according to the invention.
Figure 5:
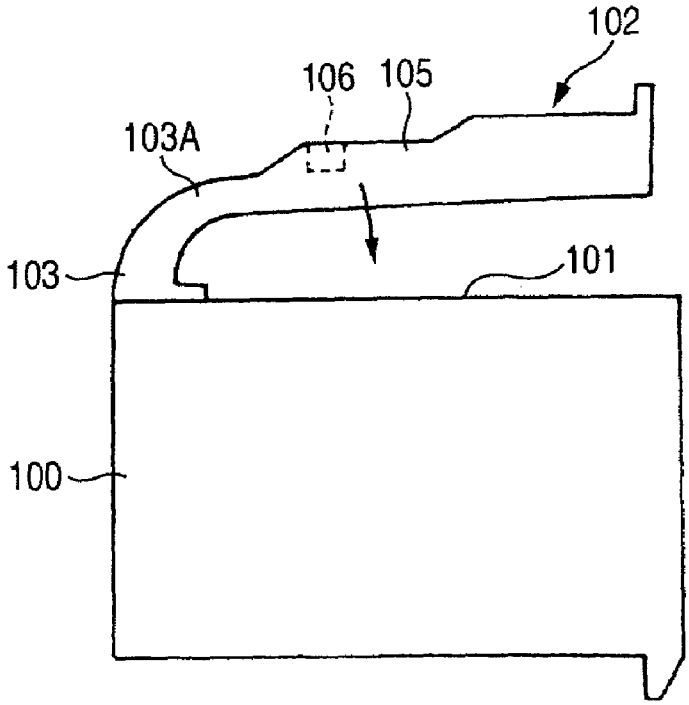
FIG. 5 is a side view showing a conventional connector.
Figure 6:
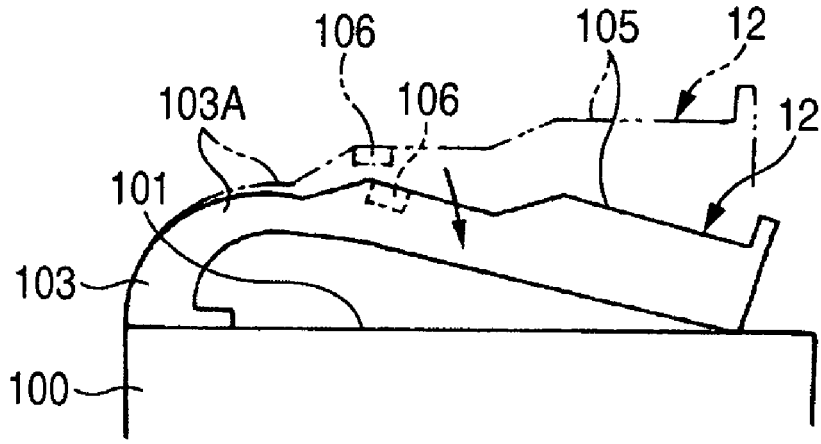
FIG. 6 is a diagram for explaining the work of a locking arm of the conventional connector.
Figure 7:
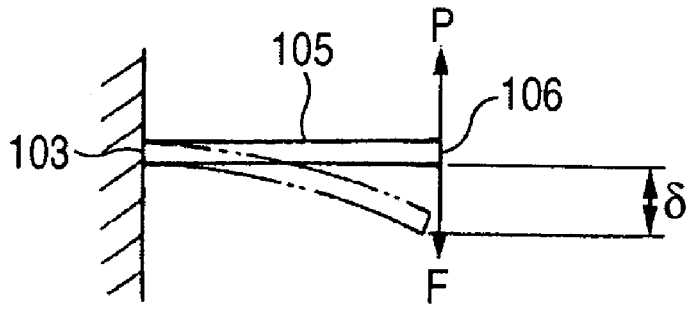
FIG. 7 is a concept diagram for explaining a feature of the locking arm of the conventional connector.

As shown in FIG. 4, by extending the elastic deformation portion 17 from the proximal end portion 16 to the fixing projection 14 linearly in the slant state, the fixing projection 14 is arranged in the higher position than the proximal end portion 16 by H, and in the position that is L distant from the proximal end portion 16.

Namely, though the height of the fixing projection 14 having the proximal end portion 16 as a starting point is the same as that of the conventional fixing projection, a virtual rotational center of the locking arm 13 comes close to the proximal end portion 16. Therefore, the distance between the virtual rotational center of the locking arm 13 and the fixing projection 14 can be made larger than the distance in the conventional case.

Accordingly, in this connector 10, compared with the conventional connector, high repulsion force is obtained in the fixing projection 14.

In case that press force F for moving this fixing projection downward is applied in the direction of an arrow, the press force F is divided into a component F1 and a component F2.

The component is force applied to the elastic deformation portion 17 in the longitudinal direction, and it is expressed by F1=F×SIN θ. This component F1 does not fill the role of causing the elastic deformation portion 17 to deform in the direction of an arrow.

On the other hand, the component F2 is force applied to the elastic deformation portion 17 in the direction orthogonal to the longitudinal direction, and it is expressed by F2=F×COS θ. This component fills the role of causing the elastic deformation portion 17 to deform in the direction of an arrow A.

In case that the elastic deformation portion 17 is thus extended from the proximal end portion 16 to the fixing projection 14 linearly in the slant state of the angle of inclination θ, only the component F2 of the press force F fills the role of causing the elastic deformation portion 17 to deform in the direction of the arrow A.

Namely, according to the invention, all of the press force F applied to the fixing projection 14 cannot be utilized as the force for causing the elastic deformation portion 17 to deform in the direction of the arrow A.

Therefore, in order to cause the elastic deformation portion to deform by the predetermined quantity, the comparatively large press force F must be applied to the fixing projection 14.

On the other hand, in a comparative example, in case that the elastic deformation portion is arranged horizontally and put in a cantilevered state, all of the press force F applied to the fixing projection 14 fills the role of causing the elastic deformation portion to deform.

Therefore, by only applying the comparatively small force F to the fixing projection, the elastic deformation portion can be deformed by the predetermined quantity δ.

Hereby, like the invention, by extending the elastic deformation portion 17 from the proximal end portion 16 to the fixing projection 14 linearly in the slant state of the angle of inclination θ, high repulsion force P is obtained in the fixing projection 14.

Therefore, according to the invention, even if the material of the connector 10 is changed to the glass reinforced material, good engagement feeling can be secured in engagement with the mating connector.

In addition, by changing the material of the connector 10 to the glass reinforced material, the cost of the connector 10 can be held.

Regarding the connector housing 11, the locking arm 13, the fixing projection 14, the elastic deformation arm 17, and the arm portion 18 that are shown in the embodiment, as long as the invention can be achieved, their materials, shapes, sizes, forms, number, arrangement, and places are arbitrary and not limited.

What is claimed is:

1. A connector comprising:

an elastically deformable locking arm integrally provided on an outer surface of a connector housing and being V-shaped, the elastically deformable locking arm having;

a fixing projection;

an elastic deformation portion extended linearly from a proximal end portion to said fixing projection in a slant state; and an arm portion extended from this fixing projection along said outer surface.

2. The connector as claimed in claim 1, further comprising:

a space, provided between an end portion of this arm portion and said outer surface, for causing said elastic deformation portion to deform elastically when the connector is engaged with the mating connector.

3. The connector as claimed in claim 1, wherein the arm portion extends substantially parallel to the outer surface.

4. The connector as claimed in claim 1, wherein the connector is made at least partially of glass reinforced material.

* * * * *